US005106524A

United States Patent [19]

Haskell, III

[11] Patent Number: 5,106,524

[45] Date of Patent: Apr. 21, 1992

[54] DRAIN PIPE OPENER

[76] Inventor: George O. Haskell, III, 550 Pierce Ave., Macon, Ga. 31204

[21] Appl. No.: 639,367

[22] Filed: Jan. 10, 1991

Related U.S. Application Data

[63] Continuation of Ser. No. 278,734, Nov. 14, 1988, abandoned.

[51] Int. Cl.[5] ..... C11D 7/08; C23G 1/02

[52] U.S. Cl. ..... 252/142

[58] Field of Search ..... 252/142

[56] References Cited

U.S. PATENT DOCUMENTS

| | | | |
|---|---|---|---|
| 3,538,008 | 11/1970 | Ancel | 252/146 |
| 3,773,910 | 11/1973 | Wilson | 423/530 |
| 4,088,596 | 5/1978 | Arai | 252/99 |
| 4,124,523 | 11/1978 | Johnson | 252/145 |
| 4,561,993 | 12/1985 | Choy | 252/174.25 |
| 4,610,800 | 9/1986 | Durham | 252/174.12 |

*Primary Examiner*—John Niebling
*Assistant Examiner*—Steven P. Marquis
*Attorney, Agent, or Firm*—Hopkins & Thomas

[57] ABSTRACT

A drain pipe opening composition in a uniformly mixed, thick, pourable form consisting of sulfuric acid and fumed silica, and a process for using such a composition to open drain pipes clogged with clogging material.

12 Claims, No Drawings

DRAIN PIPE OPENER

This is a continuation of copending application Ser. No. 07/278,734 filed on Nov. 14, 1988.

BACKGROUND OF THE INVENTION

1. Field of the Invention

The present invention relates to opening clogged drain pipes and more particularly to using a sulfuric acid composition for dissolving organic matter clogging a drain pipe. In another aspect, the present invention relates to the safer use, storage, and handling of acids and more particularly to the safer use, storage, and handling of sulfuric acid-based drain pipe openers.

2. Description of the Related Art

Acid-based drain openers in an undiluted liquid state have been available for some time; however, these drain openers are hazardous to living tissue and, in their present form, are dangerous to the user. As a liquid, they are susceptible to both unintentional spillage and accidental splashing when being used. Unless the acid is washed off the skin or neutralized immediately, severe burns may result. Furthermore, as a result of the acid's immediate reaction on contact with the standing or accumulated water in the drain pipe between the mouth of the drain and the clogging material or with the clogging organic material itself, there is a high potential for accidental flashback of the acid and contact with the skin prior to the user's removal of himself from the usage vicinity to a safe distance.

Acid silica aerogel based sewer- and drain-cleaning compositions in granular form are also available; however, these compositions have the disadvantage of being slow to act. As a granular substance, mere wetting is not sufficient to overcome the restraining effect of the silica on the sulfuric acid; the granular substance must be completely dissolved before the acid begins to react with the organic matter clogging the drain. Additionally, care must be taken when contacting the granular substance with hot water, as this results in a vigorous action which may cause splashing or flashback. Such granular substances typically have a silica content of 10% or more with a preferred range of 10% to 15%.

SUMMARY OF THE INVENTION

It is an object of the present invention to provide a novel drain pipe opener which is superior to those which are already known.

It is another object of the present invention to provide a novel drain pipe opener which is safer to use, store, and handle than those which are already known.

It is still another object of the present invention to provide a novel product of sulfuric acid which is safer and more convenient to store, handle, and transport than those which are already known.

The aforementioned objects are accomplished according to the present invention by mixing liquid sulfuric acid with fumed silica to form a uniformly mixed, thick, pourable composition of matter which has as a major proportion sulfuric acid and as a minor proportion fumed silica. The thick, pourable composition of the present invention has a comparatively reduced reaction with organic compounds or compositions such as human skin unless or until it is dissolved in water. In practice, the compositions are poured into a drain pipe which has clogging material in the drain pipe which blocks the free movement of water through the drain pipe. Generally, there is standing or accumulated water present between the drain mouth and the clogging material. The composition generally comes to settle against the clogging material and dissolves in the standing or accumulated water creating a heat of dissolvation and releasing the sulfuric acid onto the clogging material. The heated sulfuric acid reacts with and dissolves the clogging material in a safer fashion than a concentrated liquid sulfuric acid product in that accidental spillage on the skin of the thick, pourable composition will not cause the burns that the concentrated liquid sulfuric acid product will cause. Additionally, accidental flashbacks of sulfuric acid which are possible with the concentrated liquid product are avoided with the thick, pourable composition of the present invention.

Additionally, the aforementioned objects are accomplished in a safe manner according to the present invention in that the thick, pourable composition of the present invention is safer to use, handle, store, and transport than the known concentrated liquid sulfuric acid compositions. The present invention is in the form of a thick, pourable composition which is free from the possibility of spattering. Additionally, the composition does not react immediately upon contact with living tissue, but must dissolve first. This results in the ability to wipe off any of the composition contacting living tissue, and then diluting and washing off any residue before any tissue damage occurs. Furthermore, the compositions can be packaged in plastic bottle containers from which they can be poured easily. They have been demonstrated to be highly effective in dissolving and removing a variety of undesirable materials which can clog a drain pipe.

Whereas the standard liquid sulfuric acid product will, in the case of accidental spillage, quickly burn and otherwise penetrate through clothing to cause severe damage to underlying tissue, the thick, pourable composition of the present invention will require approximately ten times longer to penetrate normal clothing in order to reach underlying tissue.

DESCRIPTION OF THE INVENTION

The compositions of the present invention consist of uniform mixtures of metallically inhibited sulfuric acid and fumed silica. Fumed amorphous silica is very hydrophilic and when mixed with the sulfuric acid reacts with water present in the sulfuric acid to establish three-dimensional structures which increase viscosity. As the percentage of silica is increased, the viscosity of the silica-sulfuric acid composition increases causing the dissolvation reaction speed of the composition to decrease. This effectively decreases the reaction time of the sulfuric acid. That is, there is an inverse relationship between the viscosity of the silica-sulfuric acid composition and the reaction time of the sulfuric acid.

Exemplary of the silica powders suitable for use in the compositions of this invention are the high-surface-area silicas that are produced by well-known fuming and precipitating processes such as Aerosil®, Cab-O-Sil®, HI-Sil® and Ultrasil®. These silicas may be anhydrous or hydrated and are composed of separate discrete particles which have an average size in the range of from 2 to 50 n.

The size of the fumed silica particles is very important for two reasons. First, particle size determines the degree to which viscosity will be increased. Second, particle size has an effect on the stability of the resulting viscous mixture. The smaller the particle size of the silica, the more particles per unit weight, and the greater the surface area available to contact with the sulfuric acid. However, particle sizes which are too small are not stable for long periods of time in the sulfuric acid. The fumed silica which is most effective in increasing the viscosity of the sulfuric acid has about 200 square meters of surface area per gram of fumed silica.

Exemplary of the sulfuric acid suitable for use in the compositions of this invention is 66° Baume sulfuric acid as this type contains little water. An anhydrous sulfuric acid is especially desirable as drain pipe openers perform better when they contain as little water as possible; however, some water is necessary for the fumed silica to bind with so as to establish the increased viscosity composition which is the basis of the present invention.

The procedure for thickening sulfuric acid with fumed silica to produce the uniformly mixed, thick, pourable drain opener is as follows:

Measure 500 g of 66° Baume sulfuric acid into a 1000 ml beaker. Stir in a measured amount of fumed silica (50–400 $m^2/g$) determined by multiplying the desired weight fraction of silica by 500 g and dividing the result by the reciprocal of the desired weight fraction of silica in order to arrive at the proper weight of the silica in grams. (e.g., for 2 ½% multiply 0.025×500, then divide by 0.975 to give 12.82 gms.). See Table A The formula is:

TABLE A $$\frac{\text{Weight fraction silica} \times 500\text{ g}}{1.0 - \text{weight fraction silica}}$$

| Weight % Silica Desired | g Silica to Add to 500 g Acid |
|---|---|
| 1.0 | 5.05 |
| 2.0 | 10.20 |
| 2.5 | 12.82 |
| 3.0 | 15.46 |

Agitate for about 2 to about 3 minutes at a mixing speed of from about 10 to about 12 m/s at the tip of the mixing blade. To produce samples of 3% silica or less, add the silica to the acid. To produce samples of more than 3% silica, add the acid to the silica.

The effect of the resulting acid composition is checked by measuring the time required for one ml. of the composition to burn through the top fold of a dry paper towel under conditions where the humidity is less than 80%. See Table B. Unmixed sulfuric acid will burn through a dry paper towel in 15 seconds. With cotton, wool and parchment the unmixed surfuric acid will cause visible destruction within 30 seconds.

TABLE B

| Weight % Silica | Paper Towel Burn-Through Time in Minutes |
|---|---|
| 0 | .25 |
| 1.0 | 0.5 |
| 2.0 | 1 |
| 2.5 | 2 |

The composition dissolvation in water and heat of release upon dissolvation is measured as follows: place a thermometer calibrated to 100° C. on the bottom of a 250 ml beaker. Place 150 ml water at 20° C. into the beaker. Then measure the equivalent of 140g of sulfuric acid into the beaker. The temperature rises from 20° C. to 70° C. within from about ½ to about 1 minute. To calculate the correct amount of composition to add, divide 140 g by the reciprocal of the weight fraction of silica in the mixture. (e.g., a 3% silica-acid mixture would require a weight equal to 140 divided by 0.97 or 144.33 g.) See Table C. The formula is:

TABLE C $$\frac{140\text{ g}}{1.0 - \text{weight fraction silica}}$$

| Weight % Silica | g Composition to Add |
|---|---|
| 2.0 | 142.85 |
| 2.5 | 143.59 |
| 3.0 | 144.33 |

EXAMPLE NO. 1

1% silica-acid mixture. Add 5.05 g of 200 $m^2/g$ fumed silica to 500 g of 66° Baume sulfuric acid. The mixture thickens slightly and has a viscosity reading of 215 cps on the viscometer. One ml of the mixture on a paper towel requires 30 seconds to burn through. When 141.4 g of the mixture is added to 150 ml of water at 20° C., the temperature rises to 70° C. The effect of the 1% mixture on cotton, wool, and parchment is not visibly destructive for periods of 1 minute.

EXAMPLE NO. 2

2% silica-acid mixture. Add 10.20 g of 200 $m^2/g$ fumed silica to 500 g of 66° Baume sulfuric acid. The mixture thickens significantly and has a viscosity reading of 1400 cps on the viscometer. One ml of the mixture on a paper towel requires 1 minute to burn through. When 142.85 g of the mixture is added to 150 ml of water at 20° C., the temperature rises to 70° C. The effect of the 2% mixture on cotton, wool, and parchment is not visibly destructive for periods of 2 minutes.

EXAMPLE NO. 3

2 ½% silica-acid mixture. Add 12.82 g of 200 $m^2/g$ fumed silica to 500 g of 66° Baume sulfuric acid. The mixture thickens just short of being a gel and has a viscosity reading of 1850 cps on the viscometer. One ml of the mixture on a paper towel requires 2 minutes to burn through. When 143.59 g of the mixture is added to 150 ml of water at 20° C., the temperature rises to 70° C. The effect of the 2 ½% mixture on cotton, wool, and parchment is not visibly destructive for periods of 3 minutes.

The proportions of sulfuric acid and fumed silica according to the present invention are variable within certain limits. Compositions containing less than 1.0% by weight fumed silica do not thicken enough to achieve the objects of the present invention. Compositions containing 3.0% by weight or more fumed silica form a gel or grease-like composition which cannot be poured and which must be handled like a grease. Compositions containing a significantly higher percentage, 10% by weight or more, of fumed silica form dry, granular mixtures. Compositions containing between 1.0% to 2.9% fumed silica, and more particularly, 2.5% fumed silica, form a thick, pourable product which achieves the objects of the present invention. The heat of release generated by the exothermic reaction at the sulfuric acid is the same for the varying compositions of sulfuric acid and fumed silica. That is to say, the presence of the fumed silica does not impede the rapid generation of heat which is necessary in order for the drain pipe opener to be effective.

The product formed with a proportion of 2.5% fumed silica and 97.5% sulfuric acid is considerably safer to use than standard acid drain pipe openers. The product goes into solution very readily and produces the same heat of release as undiluted concentrated liquid acid. As such, the product according to the invention is a uniformly mixed, thick, pourable composition which, when poured into a drain pipe, penetrates through standing or accumulated water to the clogging material, goes into solution releasing heated sulfuric acid due to the heat of dissolvation, and dissolves the offending clogging material with the same power as undiluted concentrated liquid acid but in a much safer fashion.

What is claimed is:

1. A drain pipe opening composition comprising from about 97.1% to about 99.0% by weight sulfuric acid and the remainder fumed silica, said composition being in a thick, pourable, viscous liquid form.

2. A drain pipe opening composition according to claim 1 wherein said sulfuric acid consisting essentially of 97.1% to 99.0%, by weight, of said composition.

3. A drain pipe opening composition according to claim 2 wherein said sulfuric acid is 66° Baume.

4. A drain pipe opening composition according to claim 1 wherein said fumed silica constitutes from 1.0% to 2.9%, by weight, of said composition

5. A drain pipe opening composition according to claim 4 wherein said fumed silica has a surface area of about 200 $m^2/g$.

6. A drain pipe opening composition comprising:

(a) from about 97.1% to about 99.0%, by weight, 66° Baume sufuric acid; and (b) from about 1.0% to about 2.9% by weight, fumed silica with a surface area of about 200 $m^2/g$.

7. A method for opening as clogged drain pipe which has clogging material in said drain pipe blocking the free movement of water through said drain pipe and wherein water accumulates in said drain pipe between the mouth of the drain pipe and said clogging material comprising the steps of:

(a) mixing fumed silica and sulfuric acid in a sufficient quantity to produce a uniformly mixed thick, pourable, viscous liquid composition, said composition comprising from about 97.1% to about 99.0% by weight sulfuric acid and the remainder fumed silica;

(b) introducing a sufficient amount of said pourable composition into the mouth of said drain pipe such that said composition passes downwardly by gravity so as to contact said water within said drain pipe; and (c) allowing said pourable composition to remain for a sufficient time in said drain pipe and in contact with said water for at least a portion of said sulfuric acid to be dissolved into said water thereby generating heat as the sulfuric acid is dissolved by said water for producing heated diluted sulfuric acid and for a sufficient time for the sulfuric acid solution to react with the clogging material and thereby at least partially freeing the clogged material from its position blocking the flow of water in said drain pipe.

8. A method for opening a clogged drain pipe which has clogging material in said drain pipe blocking the free movement of water through said drain pipe and wherein water accumulates in said drain pipe between the mouth of the drain pipe and said clogging material as claimed in claim 2 wherein said sulfuric acid constitutes from about 97.1% to about 99.0%, by weight, of said composition.

9. A method for opening a clogged drain pipe which has clogging material in said drain pipe blocking the free movement of water through said drain pipe and wherein water accumulates in said drain pipe between the mouth of the drain pipe and said clogging material as claimed in claim 8 wherein said sulfuric acid is 66° Baume, with or without a metallic inhibitor.

10. A method for opening a clogged drain pipe which has clogging material in said drain pipe blocking the free movement of water through said drain pipe and wherein water accumulates in said drain pipe between the mouth of the drain pipe and said clogging material as claimed in claim 7 wherein said fumed silica constitutes from 1.0% to 2.9%, by weight, of said composition.

11. A method for opening a clogged drain pipe which has clogging material in said drain pipe blocking the free movement of water through said drain pipe and wherein water accumulates in said drain pipe between the mouth of the drain pipe and said clogging material as claimed in claim 10 wherein said fumed silica has a surface area of about 200 $m^2/g$.

12. A method for opening a clogged drain pipe which has clogging material in said drain pipe blocking the free movement of water through said drain pipe and wherein water accumulates in said drain pipe between the mouth of the drain pipe and said clogging material comprising the steps of:

(a) mixing fumed silica having a surface area of about 200 $m^2/g$ and 66° Baume sulfuric acid in sufficient quantity to produce a uniformly mixed pourable composition which consists essentially of from 97.1 to 99.0% by weight said sulfuric acid and from 1.0% to 2.9% by weight said fumed silica;

(b) introducing a sufficient amount of said pourable composition into the mouth of said drain pipe such that said composition passes downwardly by gravity so as to contact said water within said drain pipe; and (c) allowing said pourable composition to remain for a sufficient time in said drain pipe and in contact with said water for at least a portion of said sulfuric acid to be dissolved into said water and thereby generating heat as the sulfuric acid is dissolved by said water for producing heated diluted sulfuric acid and for a sufficient time for the sulfuric acid solution to react with the clogging material and thereby at least partially freeing the clogged material from its position blocking the flow of water in said drain pipe.

* * * * *